US007189908B2

(12) United States Patent
Lavineway

(10) Patent No.: US 7,189,908 B2
(45) Date of Patent: Mar. 13, 2007

(54) TREMOLO ASSEMBLY

(75) Inventor: Sheldon D. Lavineway, Surrey (CA)

(73) Assignee: Trem King L.L.C., Fort Worth, TX (US)

( * ) Notice: Subject to any disclaimer, the term of this patent is extended or adjusted under 35 U.S.C. 154(b) by 131 days.

(21) Appl. No.: 11/143,616

(22) Filed: Jun. 3, 2005

(65) Prior Publication Data

US 2006/0272471 A1 Dec. 7, 2006

(51) Int. Cl.
*G10D 3/00* (2006.01)

(52) U.S. Cl. ..... 84/313

(58) Field of Classification Search ..... 84/313, 84/298, 299, 267, 705
See application file for complete search history.

(56) References Cited

U.S. PATENT DOCUMENTS 4,171,661 A 10/1979 Rose
4,453,443 A * 6/1984 Smith ..... 84/298
4,457,201 A 7/1984 Storey
4,487,100 A 12/1984 Storey
4,555,970 A 12/1985 Rose
4,572,049 A * 2/1986 Tanaka et al. ..... 84/313
4,632,005 A 12/1986 Steinberger
4,656,916 A 4/1987 Gressett, Jr.
4,681,011 A 7/1987 Hoshino
4,724,737 A 2/1988 Fender
4,882,967 A 11/1989 Rose
4,928,564 A 5/1990 Borisoff et al.
4,939,971 A 7/1990 Satoh
4,967,631 A 11/1990 Rose
5,083,492 A 1/1992 Gorr
5,109,745 A 5/1992 Tomita
5,127,298 A 7/1992 Snape et al.
5,173,565 A * 12/1992 Gunn ..... 84/298
5,305,675 A 4/1994 Lasner
5,381,716 A 1/1995 May et al.
5,429,028 A 7/1995 Fisher, IV (Continued)

FOREIGN PATENT DOCUMENTS

CA 2474772 7/2004

(Continued)

*Primary Examiner*—Tho D. Ta
*Assistant Examiner*—Vanessa Girardi
(74) *Attorney, Agent, or Firm*—Oyen Wiggs Green & Mutala LLP; Richard A. Johnson

(57) ABSTRACT

A tremolo assembly for a stringed instrument such as a guitar can be used in an instrument comprising a body, a neck and a head. Strings are strung between the head and the tremolo assembly. The tremolo assembly comprises a base plate which is mounted to the body and a tone block which is pivotally attached to the base plate and extends into a cavity in the body. Saddles are attached to a top of the base plate in front of the tone block. The strings are strung over both the saddles and the tone block, and attached to the tone block near a bottom thereof. One or more tone block springs are attached between a lower portion of the tone block and the body. A tension bar is held against the back of a lower portion of the tone block by at least one tension bar spring when the tone block is in a neutral position. Stopping means are provided to prevent the tension bar from urging the tone block forward of the neutral position.

23 Claims, 4 Drawing Sheets

U.S. PATENT DOCUMENTS

| | | | | |
|---|---|---|---|---|
| 5,431,079 | A | 7/1995 | Bunker | |
| 5,477,765 | A | 12/1995 | Dietzman | |
| 5,539,143 | A | 7/1996 | Rose | |
| 5,551,329 | A | 9/1996 | Iovane | |
| 5,637,818 | A | 6/1997 | Fishman et al. | |
| 5,783,763 | A | 7/1998 | Schaller et al. | |
| 5,864,074 | A | 1/1999 | Hill | |
| 5,880,383 | A | 3/1999 | Huff | |
| 5,986,190 | A | 11/1999 | Wolff et al. | |
| 6,084,166 | A * | 7/2000 | Lee | 84/313 |
| 6,300,550 | B1 | 10/2001 | Smith | |
| 6,710,235 | B2 | 3/2004 | Hirayama | |
| 6,812,389 | B2 | 11/2004 | Trooien | |
| 2003/0066408 | A1 | 4/2003 | Hirayama | |
| 2003/0110920 | A1 | 6/2003 | Ito et al. | |
| 2003/0177883 | A1 | 9/2003 | Rose et al. | |
| 2004/0051925 | A1 * | 3/2004 | Smart | 359/237 |
| 2004/0159204 | A1 | 8/2004 | Rose | |
| 2004/0255752 | A1 | 12/2004 | Geier | |

FOREIGN PATENT DOCUMENTS

| | | |
|---|---|---|
| GB | 2259393 | 3/1993 |
| GB | 2368711 | 5/2002 |
| WO | WO 03/060874 | 7/2003 |

* cited by examiner

TREMOLO ASSEMBLY

TECHNICAL FIELD

The invention relates to stringed instruments, and particularly to stringed instruments wherein the tension in the strings may be varied by a user while the user is playing the instrument, such as for example, electric guitars.

BACKGROUND

Stringed instruments such as guitars sometimes have tremolo systems which a user may use to vary the tension in the strings. A tremolo system typically comprises a vibrato bar. The user may press the vibrato bar toward the instrument's body to lower the tension in the strings, and pull the vibrato bar away from the instrument's body to increase the tension in the strings thereby altering the pitch of sound produced by playing the strings.

U.S. Pat. No. 5,381,716 to May et al. discloses a tremolo system which includes a base plate and a block member. The base plate is attached to the upper surface of the instrument's body. The base plate has a pair of laterally opposed first bearing portions located within the body which cooperate with a pair of second bearing portions on the block member. The block member pivots about an axis below the upper surface of the body. The strings are attached to an upper portion of the block member above the pivot axis of the block member. Springs are attached between the body and a lower portion of the block member. A tremolo lever is attached to the upper portion of the block member. A user may vary the tension in the strings by raising or lowering the tremolo lever. When the lever is released the system returns to an equilibrium position under the influence of either the strings or the springs, depending on the direction of movement of the lever. The tension in the springs must be matched by the tension in the strings in order to ensure that the system returns to the equilibrium position.

The inventor has determined that there exists a need for improved tremolo systems which provide a user with the ability to vary the tension in the strings of a stringed instrument while playing the instrument.

SUMMARY

One aspect of the invention provides a tremolo assembly for a stringed instrument having a body with a cavity defined therein and an aperture extending between the cavity and a top surface of the body. The tremolo assembly comprises a base plate mounted on the top surface of the body adjacent to the aperture in the top surface of the body, a plurality of saddles coupled to the top surface of the body in front of the recess in the top surface of the body for receiving a plurality of strings, and a tone block pivotally attached at an upper portion thereof to the base plate. The tone block extends downwardly through the aperture in the body into the cavity. The tone block has a vibrato bar coupled to an upper portion thereof and a plurality of string holders therein for receiving ends of the plurality of strings. The plurality of strings are strung over a top of the tone block and attached to the string holders such that tension in the strings causes a torque on the tone block resulting in a rearward force on the bottom portion of the tone block. At least one tone block spring is attached between the bottom portion of the tone block and the body for exerting a first forward force on the bottom portion of the tone block. A tension bar is positioned behind the tone block. Stopping means are provided for preventing the tension bar from moving the bottom portion of the tone block forward of a neutral position wherein the tension bar abuts the bottom portion of the tone block. At least one tension bar spring is coupled between the tension bar and the body for exerting a second forward force on the tension bar. The first forward force has a magnitude less than a magnitude of the rearward force, and the first and second forward forces together have a magnitude greater than the magnitude of the rearward force, such that the tone block may be moved toward a sharp position by pulling the vibrato bar away from the body, the tone block may be moved toward a flat position by pushing the vibrato bar toward the body, and the tone block is returned to the neutral position when no force is exerted on the vibrato bar.

Another aspect of the invention provides a tremolo assembly for a stringed instrument having a body with a cavity defined therein and an aperture extending between the cavity and a top surface of the body. The tremolo assembly comprises a base plate mounted on the top surface of the body adjacent to the aperture in the top surface of the body, a plurality of saddles coupled to the top surface of the body in front of the recess in the top surface of the body for receiving a plurality of strings, and a tone block pivotally attached at an upper portion thereof to the base plate. The tone block is configured to pivot about an axis above the top surface of the body. The tone block extends downwardly through the aperture in the body into the cavity. The tone block has a recess in the upper portion thereof for receiving a vibrato bar and a plurality of string holders in a bottom portion thereof for receiving ends of the plurality of strings. The plurality of strings are strung from the saddles over a top of the tone block, down a back of the tone block and attached to the string holders such that tension in the strings causes a torque on the tone block resulting in a rearward force on the bottom portion of the tone block. A biasing means is attached between the bottom portion of the tone block and the body for exerting a forward force on the bottom portion of the tone block. The tone block is maintained in a neutral position by the tension in the strings and the biasing means when no force is exerted on the vibrato bar.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in the appended drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

A tremolo assembly for a stringed instrument such as a guitar is provided. The instrument comprises a body, a neck and a head. Strings are strung between the head and the tremolo assembly. The tremolo assembly comprises a base plate which is mounted to the body and a tone block which is pivotally attached to the base plate and extends into a recess in a top surface of the body. Saddles are held fixed with respect to the body in front of the tone block. In this description and the following claims, "front" refers to the direction toward the head of the instrument, and "back" refers to the direction away from the head. Also "top" refers to the side of the instrument on which the strings are located, and "bottom" refers to the opposite side of the instrument.

The strings are strung over both the saddles and a top of the tone block, and attached to the tone block. One or more tone block springs are attached between a lower portion of the tone block and the body. A tension bar is held against the back of a lower portion of the tone block by at least one tension bar spring when the tone block is in a neutral position. Stopping means are provided to prevent the tension bar from urging the tone block forward of the neutral position.

A vibrato bar is coupled to the tone block. A user may increase the tension in the strings by pulling the vibrato bar away from the body, which urges the bottom portion of the tone block forward. This motion is resisted by the strings, and assisted by the tone block springs. When the vibrato bar is released the strings pull the tone block back to the neutral position.

Similarly, the user may decrease the tension in the strings by pushing the vibrato bar toward the body, which urges the bottom portion of the tone block and the tension bar rearward. This motion is assisted by the strings, and resisted by the tone block springs and the tension bar spring. When the vibrato bar is released the tone block springs and the tension bar spring pull the tone block back into the neutral position.

Figure 1:
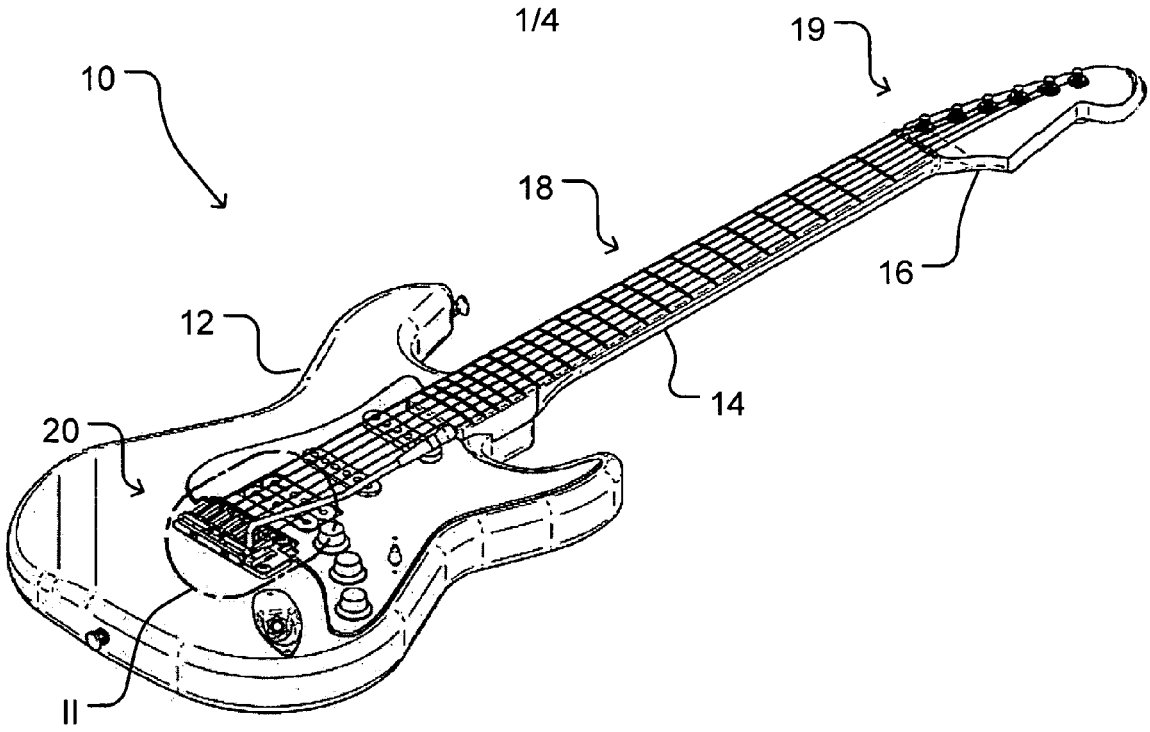
FIG. 1 shows a guitar having a tremolo system according to one embodiment of the invention.

FIG. 1 shows a guitar 10 having a tremolo assembly 20 according to one embodiment of the invention. Guitar 10 comprises a body 12, a neck 14 and a head 16. Body 12 has a cavity 13 defined therein (see FIGS. 3 and 4). An aperture 15 extends from cavity 13 to the top of body 12, forming a recess in the top surface of body 12. Strings 18 are strung between tuning posts 19 on head 16 and tremolo assembly 20. A vibrato bar 21 extends upwardly and forwardly from tremolo assembly 20 to a position where a user may conveniently grasp vibrato bar 21 while playing guitar 10.

Figure 2:
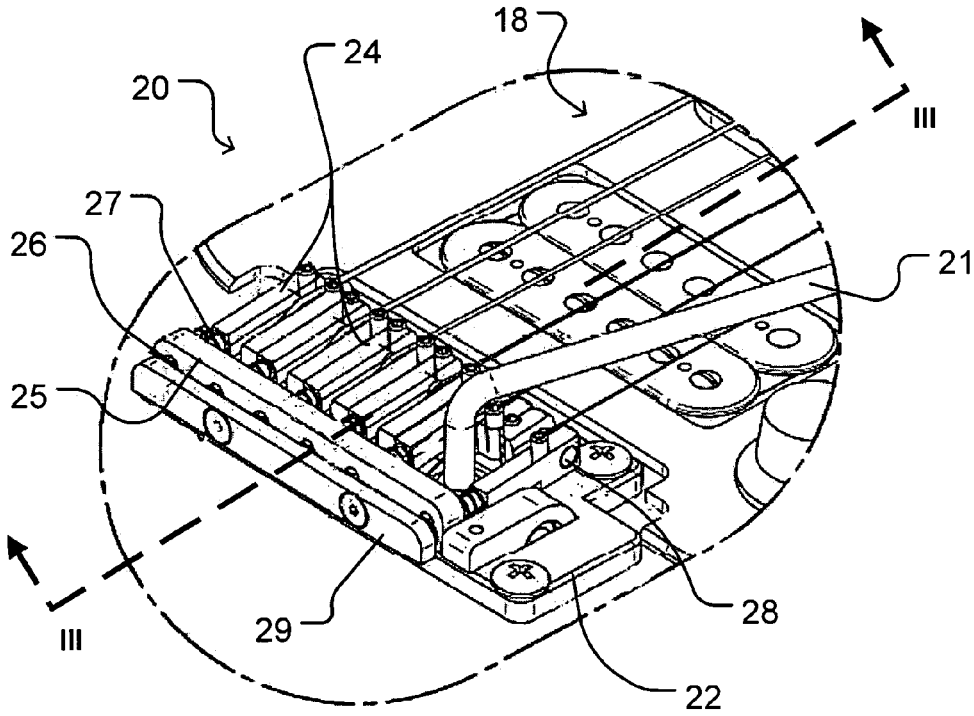
FIG. 2 shows an enlarged view of the region indicated by oval II of FIG. 1.

FIG. 2 is an enlarged view of tremolo assembly 20 of FIG. 1. Tremolo assembly 20 comprises a base plate 22 having six saddles 24. Saddles 24 may be mounted on base plate 22, or may be otherwise held fixed with respect to body 12. Each saddle 24 comprises a notch for receiving one of strings 18 and a pin 28 inserted transversely therethrough for slidably supporting string 18. Pins 28 are preferably constructed from a composite material, graphite, tusk, bone, or other friction reducing material, such that wear on strings 18 is reduces when strings 18 slide across pins 28 during operation of tremolo assembly 20, as described below. Pins 28 according to the invention may be used in connection with any tremolo assembly in which the strings slide back and forth across the saddles to reduce wearing of the strings.

Saddles 24 are attached to a rear flange 25 of base plate 22 by mounting screws 26. Mounting screws 26 may be slidably received in apertures in flange 25. Each saddle 24 may also be provided with set screws (not shown) for adjusting the height thereof as known in the art. A spring 27 may optionally be provided between each saddle 24 and rear flange 25. The intonation of strings 18 may be set by adjusting mounting screws 26 as known in the art. Once the intonation is set, a harness bar 29 may be attached to flange 25 behind the heads of mounting screws 26 to prevent saddles 24 from moving during operation of tremolo assembly 20, as described below. A harness bar 29 according to the invention may be used in connection with any tremolo assembly in which the strings slide back and forth across the saddles to prevent movement of the saddles when the tremolo assembly is operated.

Figure 3:
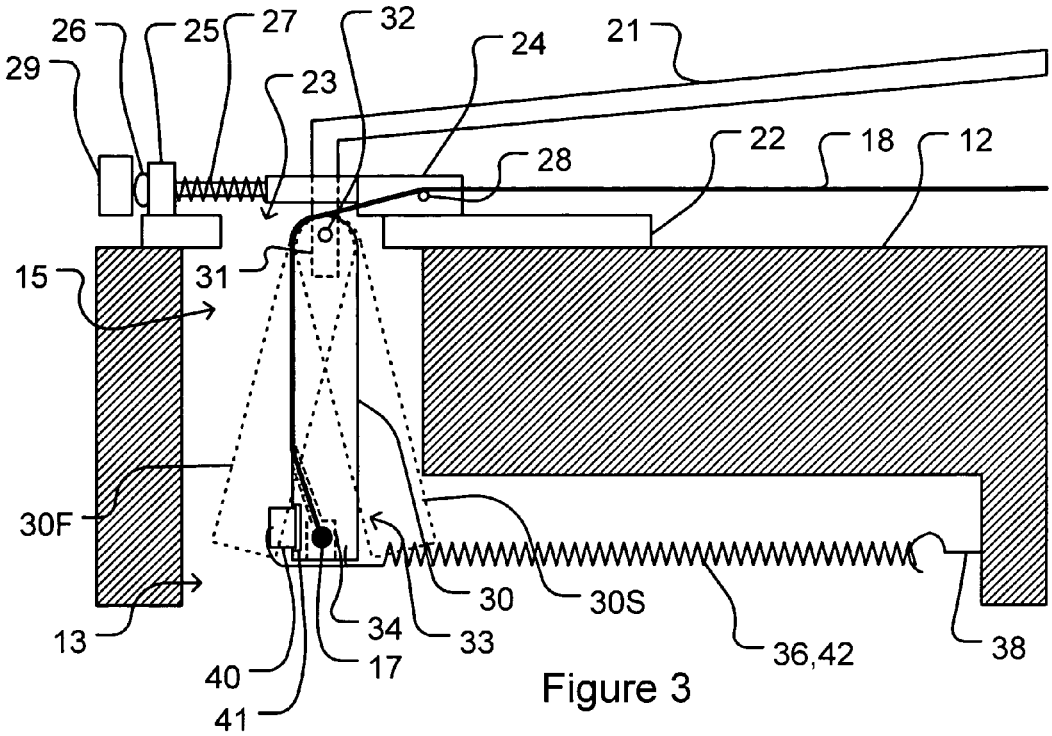
FIG. 3 is a sectional view taken along the line III—III of FIG. 2.
Figure 4:
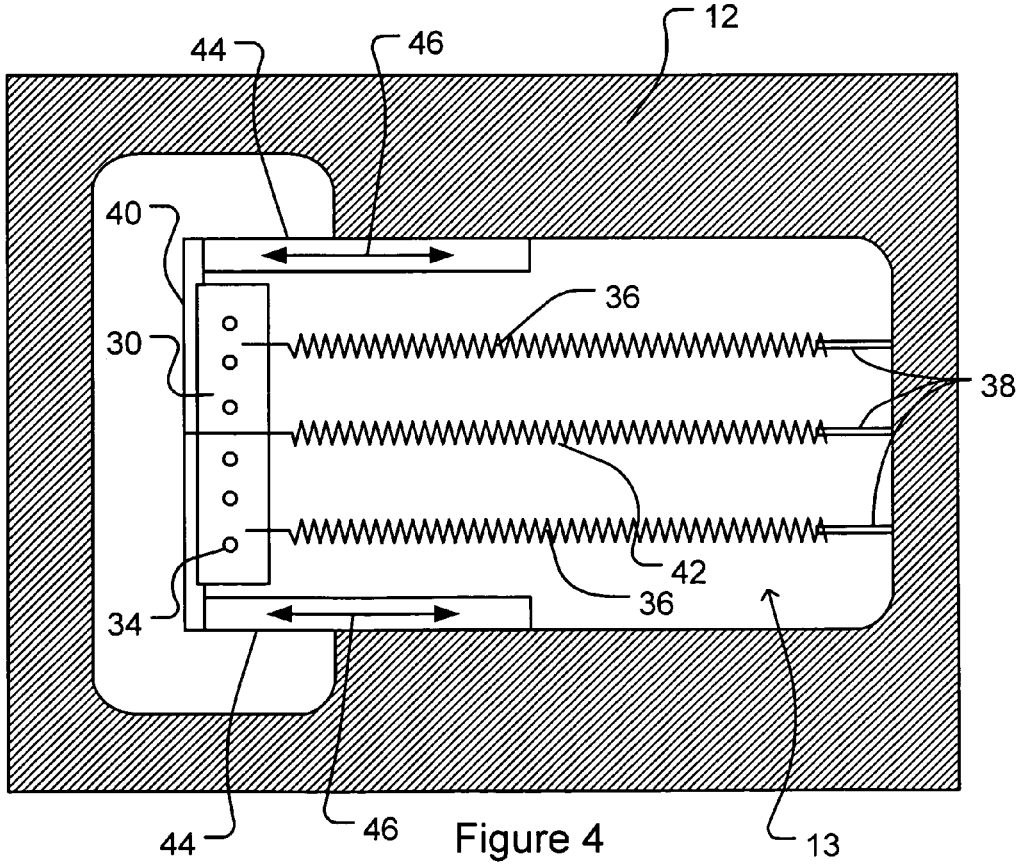
FIG. 4 is a bottom view of the tremolo system of FIG. 3.

As shown in FIG. 3, base plate 22 has an aperture 23 therethrough. Alternatively, base plate 22 may comprise separate elements attached to body 12 adjacent aperture 15. A tone block 30 is pivotally coupled to base plate 22 within aperture 23. In the illustrated embodiment, tone block 30 is attached to base plate 22 by means of pivots 32 (only one of which is shown in FIG. 3). Pivots 32 define an axis which is above the top surface of body 12. The top of tone block 30 is below pins 28 of saddles 24, so the height of strings 18 above body 12 will not change during the operation of tremolo assembly 20. Tone block 30 extends though aperture 15 into cavity 13. Strings 18 have enlarged ends 17, and are held by string holders which may comprise holes 34 cut at an angle through a bottom portion 33 of tone block 30. Holes 34 have enlarged lower portions and narrow upper portions for retaining ends 17 of strings 18. Alternatively, the string holders may comprise slots (not shown) cut at an angle through bottom portion 33 of tone block 30.

Strings 18 are strung from the string holders in tone block 30, over the top of tone block 30, over pins 28 and connected to tuning posts 19 in head 16 under tension. The tension in strings 18 generates a torque on tone block 30 which biases bottom portion 33 of tone block 30 rearwardly.

The arrangement of base plate 22 and tone block 30 wherein tone block 30 pivots about an axis above the top of body 12, with strings 18 attached to the bottom portion of tone block 30, enables tremolo assembly 20 to extend no further away from body 12 than saddles 24 and flange 25. This is advantageous in that many musicians are used to playing instruments having saddles and flanges with similar heights to those of saddles 24 and flange 25 shown in FIGS. 1 and 2. Further, this arrangement allows the outward appearance of tremolo assembly 20 to be similar to that of the vintage Fender™ Stratocaster™ tremolo, thereby adding to the aesthetic appeal of tremolo assembly 20, which can be an important concern in the music industry.

Vibrato bar 21 is inserted into a recess 31 in the top of tone block 30. A set screw (not shown) may be provided to hold vibrato bar 21 in place. Guitar 10 is preferably tuned with tone block 30 in the neutral position, as indicated by the solid lines in FIG. 3. Tone block 30 may be pivoted about pivot 32 between a sharp position 30S and a flat position 30F, as indicated by the dotted lines in FIG. 3, by moving vibrato bar 21 upwardly (i.e., away from body 12) and downwardly (i.e., toward body 12), respectively. When tone block 30 is moved from the neutral position toward sharp position 30S the tension in strings 18 is increased, causing strings 18 to generate higher pitched sounds when played. When tone block 30 is moved from the neutral position toward flat position 30F the tension in strings 18 is decreased, causing strings 18 to generate lower pitched sounds when played.

A biasing means is attached to the bottom of tone block 30. The biasing means may comprise, for example, one or more springs attached to the bottom of tone block 30. In the illustrated embodiment, two tone block springs 36 are attached to the bottom of tone block 30. The forward ends of tone block springs 36 are attached to hooks 38 extending from body 12 at the forward portion of cavity 13. A tension bar 40 abuts the back of tone block 30 when tone block 30 is in the neutral position. Tension bar 40 may be received in a recess 41 in the back of tone block 30. A tension bar spring 42 is attached between tension bar 40 and one of hooks 38.

Figure 5:
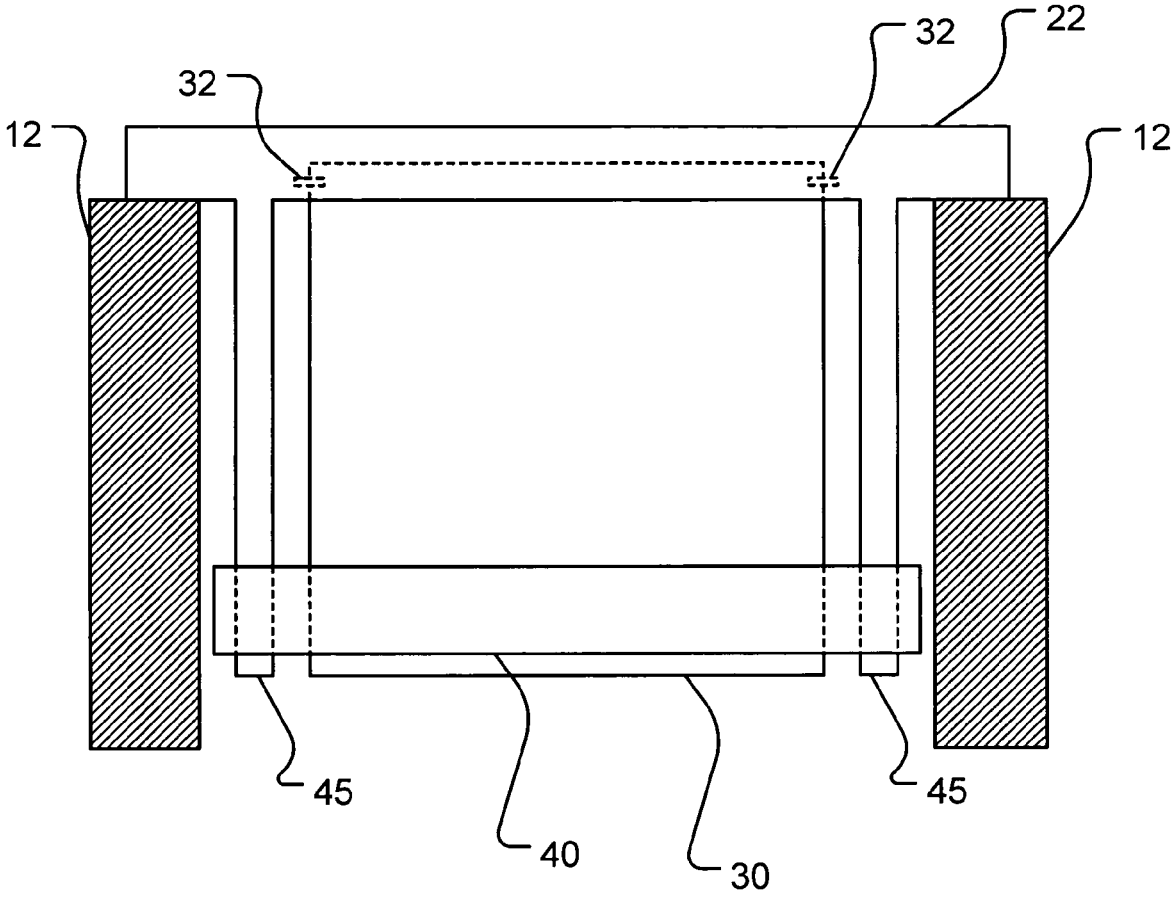
FIG. 5 shows a rear view of a tremolo assembly according to another embodiment of the invention.

Stopping means are provided to prevent tension bar 40 from pushing bottom portion 33 of tone block 30 forward of the neutral position. In the illustrated embodiment, the stopping means comprise two stop members 44 attached to body 12 at the edges of cavity 13. Tension bar 40 abuts stop members 44 when tone block 30 is in the neutral position and when tone block 30 is moved toward sharp position 30S. In another embodiment, as shown in FIG. 5, the stopping means comprise arms 45 extending downwardly from base plate 22 on either side of tone block 30. Alternatively, the stopping means could comprise one or more wires (not shown) attached between the back of cavity 13 and tension bar 40. As another alternative, the stopping means could comprise a post (not shown) which extends upwardly from a cover (not shown) which covers the bottom of cavity 13, and tone block 30 could comprise a notch (not shown) in the bottom thereof sized to allow tone block 30 to pass the post.

Tone block springs 36, tension bar 40 and tension bar spring 42 exert a forward force on the bottom portion of tone block 30. Tone block springs 36 are selected such that the combined forward force exerted thereby on bottom portion 33 of tone block 30 is less than the rearward force on the bottom portion of tone block 30 caused by the torque generated by strings 18. This results in a net rearward force on bottom portion 33 of tone block 30. Tension bar spring 42 is selected such that the forward force exerted thereby on tension bar 40 is greater than the net rearward force exerted on bottom portion 33 of tone block 30.

Tone block 30 remains in the neutral position, and tension bar 40 remains against stop members 44, when no force is applied to vibrato bar 21. This arrangement allows the tension in strings 18 to be adjusted within a range which produces a rearward force having a magnitude that is between a magnitude of the forward force exerted by tone block springs 36 and the magnitude of the combined forward force exerted by tone block springs 36 and tension bar spring 42, without requiring any adjustment of the forward forces exerted by tone block springs 36 and tension bar spring 42. Stop members 44 may be adjustably connected to body 12, as indicated by arrows 46, such that the location of the neutral position of tone block 30 may be varied. The distance which each of hooks 38 extends into cavity 13 may be varied to alter the forward forces exerted by tone block springs 36 and tension bar spring 42 so that the permissible range of tension in strings 18 may be varied.

Figure 6:
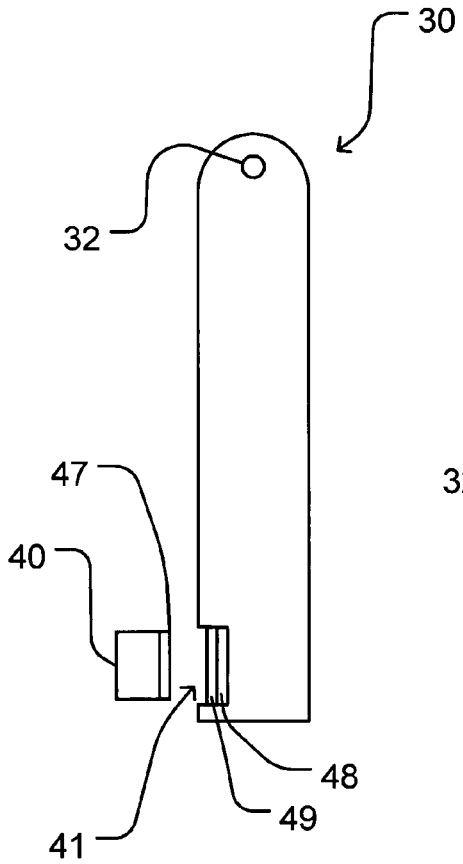
FIG. 6 shows the tone block and tension bar of FIG. 3 in isolation.

As shown in FIG. 6, tension bar 40 may comprise a strip 47 of leather or a similar vibration reducing material on the front thereof. Also, recess 41 may be provided with a strip 48 of rubber or a similar shock absorbing material and a strip 49 leather or a similar vibration reducing material therein. Strips 47, 48 and 49 serve to reduce unwanted vibrations which may be caused if a user moves tone block 30 from the neutral position toward the sharp position 30S and releases vibrato bar 21, causing tone block 30 to return rapidly to the neutral position.

Figure 7:
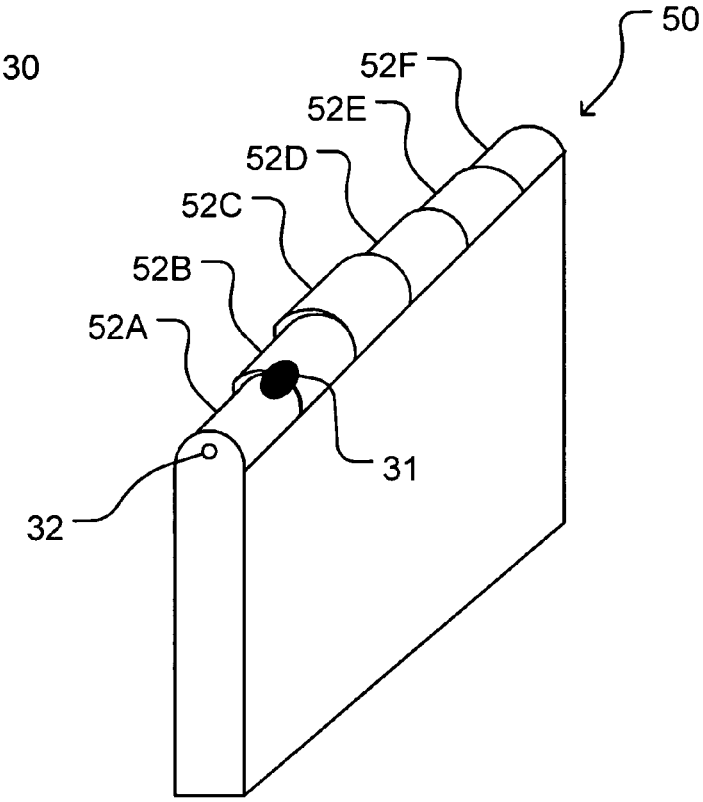
FIG. 7 is an isometric view of a tone block according to another embodiment of the invention.

FIG. 7 shows a tone block 50 according to another embodiment of the invention. Tone block 50 is generally the same as tone block 30, except tone block 50 comprises six sections 52A–F, each corresponding to one of strings 18. Each section 52 may have a differently shaped upper portion. The amount by which the tension and therefore the pitch of each of strings 18 changes when tone block 50 is displaced from the neutral position may be individually selected by selecting the shape of sections 52A–F.

Figure 8:
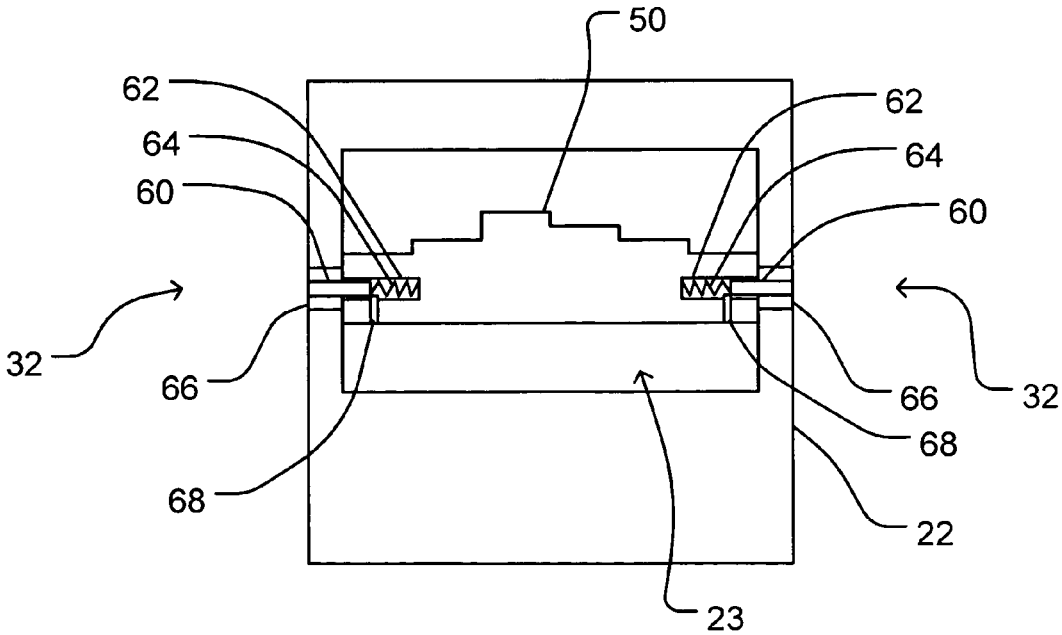
FIG. 8 shows the tone block of FIG. 6 attached to a base plate.

FIG. 8 shows tone block 50 attached to base plate 22 by means of pivots 32. In the FIG. 7 embodiment, each pivot 32 comprises a pin 60 attached within a recess 62 in tone block 50 by means of a spring 64. Pin 60 is received within a corresponding bushing 66 in base plate 22. A set screw 68 may be provided to maintain pin 60 in an extended position when tremolo assembly 20 is installed. Tone block 50 may be removed by loosening set screws 68 and pressing pins 60 into recesses 62. Tone block 30 may be attached to base plate 22 in the same manner as tone block 50.

While a number of exemplary aspects and embodiments have been discussed above, those of skill in the art will recognize certain modifications, permutations, additions and sub-combinations thereof. For example:

The biasing means may comprise one or more compression springs attached to the body at a rearward portion of the cavity instead of extension springs attached to the body at a forward portion of the cavity.

The biasing means could comprise a different number of springs than shown in the illustrated embodiments.

The saddles could be mounted directly to the body, or mounted on a separate plate, rather than being mounted to the base plate.

It is therefore intended that the following appended claims and claims hereafter introduced are interpreted to include all such modifications, permutations, additions and sub-combinations as are within their true spirit and scope.

What is claimed is:

1. A tremolo assembly for a stringed instrument having a body with a cavity defined therein and an aperture extending between the cavity and a top surface of the body, the tremolo assembly comprising:

a base plate mounted on the top surface of the body adjacent to the aperture in the top surface of the body;

a plurality of saddles coupled to the top surface of the body in front of the aperture in the top surface of the body for receiving a plurality of strings;

a tone block pivotally coupled at an upper portion thereof to the base plate, the tone block extending downwardly through the aperture in the body into the cavity, the tone block having a vibrato bar coupled to an upper portion thereof and a plurality of string holders therein for receiving ends of the plurality of strings, the plurality of strings being strung over a top of the tone block and attached to the string holders such that tension in the strings causes a torque on the tone block resulting in a rearward force on the bottom portion of the tone block;

at least one tone block spring attached between the bottom portion of the tone block and the body for exerting a first forward force on the bottom portion of the tone block;

a tension bar positioned behind the tone block;

stopping means for preventing the tension bar from moving the bottom portion of the tone block forward of a neutral position wherein the tension bar abuts the bottom portion of the tone block; and, at least one tension bar spring coupled between the tension bar and the body for exerting a second forward force on the tension bar, wherein the first forward force has a magnitude less than a magnitude of the rearward force, and the first and second forward forces together have a magnitude greater than the magnitude of the rearward force, such that the tone block may be moved toward a sharp position by pulling the vibrato bar away from the body, the tone block may be moved toward a flat position by pushing the vibrato bar toward the body, and the tone block is returned to the neutral position when no force is exerted on the vibrato bar.

2. A tremolo assembly according to claim 1 wherein the at least one tone block spring comprises a pair of tone block springs coupled between a pair of hooks extending rearwardly from the body at a forward edge of the cavity and symmetrical locations on a bottom of the tone block.

3. A tremolo assembly according to claim 2 wherein the at least one tension bar spring comprises a single tension bar spring coupled between a central hook extending rearwardly from the body at a forward edge of the cavity between the pair of hooks and a central location on the tension bar.

4. A tremolo assembly according to claim 3 wherein a distance which each of the pair of hooks and the central hook extends from the body is adjustable.

5. A tremolo assembly according to claim 1 wherein the stopping means comprise a pair of stop members attached to the body at opposite edges of the cavity adjacent to the bottom portions of the tone block.

6. A tremolo assembly according to claim 5 wherein a position of the stop members is adjustable forwardly and rearwardly to vary a location of the neutral position.

7. A tremolo assembly according to claim 1 wherein the stopping means comprise a pair of arms extending downwardly from the base plate on either side of the tone block.

8. A tremolo assembly according to claim 1 wherein the tone block is connected to the base plate by a pair of pivots defining an axis which is above a top surface of the body.

9. A tremolo assembly according to claim 8 wherein each of the pivots comprises a pin extending outwardly from the tone block into a corresponding bushing in the base plate.

10. A tremolo assembly according to claim 9 wherein each of the pins of the pivots is attached within a recess in the tone block by means of a spring attached to the tone block.

11. A tremolo assembly according to claim 8 wherein the string holders are located below the axis.

12. A tremolo assembly according to claim 11 wherein the string holders comprise holes having enlarged lower portions and narrow upper portions for retaining enlarged ends of the strings.

13. A tremolo assembly according to claim 1 wherein the base plate comprises a rear flange and the saddles are attached to the rear flange by mounting screws which are slidably received in apertures in the rear flange, the mounting screws having heads which are behind the rear flange, further comprising a harness bar attached to a backside of the rear flange behind the heads of the mounting screws to hold the heads of the mounting screws against the rear flange.

14. A tremolo assembly according to claim 13 wherein no portion of the tremolo assembly other than the vibrato bar extends further away from body than the rear flange and the saddles.

15. A tremolo assembly according to claim 1 wherein the tone block comprises a recess in a lower rear portion thereof for receiving the tension bar.

16. A tremolo assembly according to claim 15 wherein the tension bar comprises a strip of vibration reducing material on a front side thereof.

17. A tremolo assembly according to claim 16 wherein the tone block comprises a strip of shock absorbing material within the recess and a strip of vibration reducing material atop the strip of shock absorbing material.

18. A tremolo assembly according to claim 1 wherein the tone block comprises a plurality of sections, each of the plurality of sections corresponding to one of the strings, each of the plurality of sections having an upper portion shaped to produce an individually selected change in the tension in the corresponding string when the tone block is displaced from the neutral position.

19. A guitar comprising:

a body with a cavity defined therein and an aperture extending between the cavity and a top surface of the body;

a neck extending forwardly from the body;

a head attached to a forward end of the neck, the head comprising a plurality of tuning posts;

a tremolo assembly mounted on the top surface of the body; and, a plurality of strings strung between the tuning posts and the tremolo assembly, wherein the tremolo assembly comprises:

a base plate mounted on the top surface of the body adjacent to the aperture in the top surface of the body;

a plurality of saddles coupled to the top surface of the body in front of the aperture in the top surface of the body for receiving the plurality of strings;

a tone block pivotally attached at an upper portion thereof to the base plate, the tone block extending downwardly through the aperture in the body into the cavity, the tone block having a vibrato bar coupled to an upper portion thereof and a plurality of string holders therein for receiving ends of the plurality of strings, the plurality of strings being strung over a top of the tone block and attached to the string holders such that tension in the strings causes a torque on the tone block resulting in a rearward force on the bottom portion of the tone block;

at least one tone block spring attached between the bottom portion of the tone block and the body for exerting a first forward force on the bottom portion of the tone block;

a tension bar positioned behind the tone block;

stopping means for preventing the tension bar from moving the bottom portion of the tone block forward of a neutral position wherein the tension bar abuts the bottom portion of the tone block; and, at least one tension bar spring coupled between the tension bar and the body for exerting a second forward force on the tension bar, wherein the first forward force has a magnitude less than a magnitude of the rearward force, and the first and second forward forces together have a magnitude greater than the magnitude of the rearward force, such that the tone block may be moved toward a sharp position by pulling the vibrato bar away from the body, the tone block may be moved toward a flat position by pushing the vibrato bar toward the body, and the tone block is returned to the neutral position when no force is exerted on the vibrato bar.

20. A tremolo assembly for a stringed instrument having a body with a cavity defined therein and an aperture extending between the cavity and a top surface of the body, the tremolo assembly comprising:

a base plate mounted on the top surface of the body adjacent to the aperture in the top surface of the body;

a plurality of saddles coupled to the top surface of the body in front of the recess in the top surface of the body for receiving a plurality of strings;

a tone block pivotally attached at an upper portion thereof to the base plate and configured to pivot about an axis above the top surface of the body, the tone block extending downwardly through the aperture in the body into the cavity, the tone block having a recess in the upper portion thereof for receiving a vibrato bar and a plurality of string holders in a bottom portion thereof for receiving ends of the plurality of strings, the plurality of strings being strung from the saddles over a top of the tone block, down a back of the tone block and attached to the string holders such that tension in the strings exerts a rearward force on the bottom portion of the tone block; and biasing means attached between the bottom portion of the tone block and the body for exerting a forward force on the bottom portion of the tone block, whereby the tone block is maintained in a neutral position by the tension in the strings and the biasing means when no force is exerted on the vibrato bar.

21. A tremolo assembly according to claim 20 wherein a top of the tone block is at a location below a top of the saddles.

22. A tremolo assembly according to claim 20 wherein a plurality of saddles are coupled to the body for receiving a plurality of strings, the tremolo assembly configured to move the strings back and forth in a lengthwise direction across the saddles, the improvement comprising: a transverse pin in each saddle positioned to bear against the string received therein, the pin comprising a friction reducing material for reducing wearing of the string.

23. In a tremolo assembly for a stringed instrument having a body and a base plate mounted on the body, the base plate comprising a flange and a plurality of saddles in front of the flange for receiving a plurality of strings, each saddle coupled to the flange by a mounting screw which is slidably received in an aperture in the flange with a head on a rear side of the flange, and a spring positioned about the mounting screw between the saddle and a forward side of the flange, the tremolo assembly configured to move the strings back and forth in a lengthwise direction across the saddles, the improvement comprising:

a harness bar attached to the rear side of the flange for holding the heads of the mounting screws against the flange.

* * * * *